United States Patent [19]

Markow et al.

[11] Patent Number: 5,014,323

[45] Date of Patent: May 7, 1991

[54] VOICE COIL LEAD DRESSING

[75] Inventors: Mitch A. Markow, Natick; Dale O. Moody, Leominster; Hal P. Greenberger, Hopedale, all of Mass.

[73] Assignee: Bose Corporation, The Mountain, Framingham, Mass.

[21] Appl. No.: 387,239

[22] Filed: Jul. 28, 1989

[51] Int. Cl.[5] ..... H04R 9/04

[52] U.S. Cl. ..... 381/194; 381/196; 381/199

[58] Field of Search ..... 381/194, 196, 199

[56] References Cited

U.S. PATENT DOCUMENTS 4,061,890 12/1977 Froeschle ..... 381/194
4,088,847 5/1978 Yukimoto et al. ..... 381/194
4,158,756 6/1979 Keezer ..... 381/194
4,737,992 4/1988 Brown et al. ..... 381/194

*Primary Examiner*—Jin F. Ng
*Assistant Examiner*—M. Nelson McGeary, III
*Attorney, Agent, or Firm*—Fish & Richardson

[57] ABSTRACT

A moving coil loudspeaker including a bobbin, a cone secured to the bobbin by cement, a spider secured to the bobbin by the cement, a voice coil including a first electrical wire that is wrapped around the bobbin and has ends supported by the bobbin, and flexible second and third electrical wires for making electrical connection of the first electrical wire to external circuitry, the second and third wires being connected to the ends of the first wire by connections that are anchored on the bobbin by the cement securing the spider and the cone to the bobbin.

13 Claims, 1 Drawing Sheet

VOICE COIL LEAD DRESSING

The present invention relates in general to electroacoustical transducing and more particularly concerns a novel voice coil lead dressing for a moving coil loudspeaker and a method of manufacture thereof.

BACKGROUND OF THE INVENTION

Moving coil loudspeakers traditionally have a voice coil that moves up and down and is attached to a cone which in turn vibrates to induce sound waves. The ends of the voice coil are typically connected to flexible tinsel leads which are carried by and pass through the cone and are connected to terminals on a basket of the loudspeaker. The voice coil wire can be subjected to mechanical fatigue caused by the relative motion between the coil and the cone. Accordingly, the electrical connection between the electrical wire of the voice coil and the tinsel leads have been anchored in some instances in the past on the bobbin of the voice coil by cement so that the more flexible tinsel is subjected to the motion. Rectangular cross-section electrical wires, which are particularly subject to fatigue, have been used in the voice coils, as is disclosed in U.S. Pat. No. 4,061,890. The electrical connections between the voice coil wires and tinsel leads have included crimping, as is disclosed in U.S. Pat. No. 4,737,992.

SUMMARY OF THE INVENTION

In general, the invention features a moving coil loudspeaker in which the electrical connection between the electrical wires at the ends of the voice coil and the flexible tinsel lead is anchored to the bobbin of the voice coil via cement also used to secure the spider and cone to the bobbin. The crimped connection of the voice coil wires to flexible tinsel leads is thus desirably anchored to the bobbin and done so using the same cement used to secure the spider and the cone to the bobbin and without an additional manufacturing step.

In preferred embodiments, the tinsel leads are connected to the voice coil wires via a crimp; the crimp is located between the bobbin and the inner diameter of the cone or spider; and the cone has two notches at its inner diameter for receiving the crimps. The encapsulating of the crimps in the neck joint adhesive under the cone and/or spider inner diameters improves the reliability of the connection and its anchoring to the bobbin.

Other advantages and features of the invention will be apparent from the following detailed description and from the claims.

DETAILED DESCRIPTION

Figure 1:
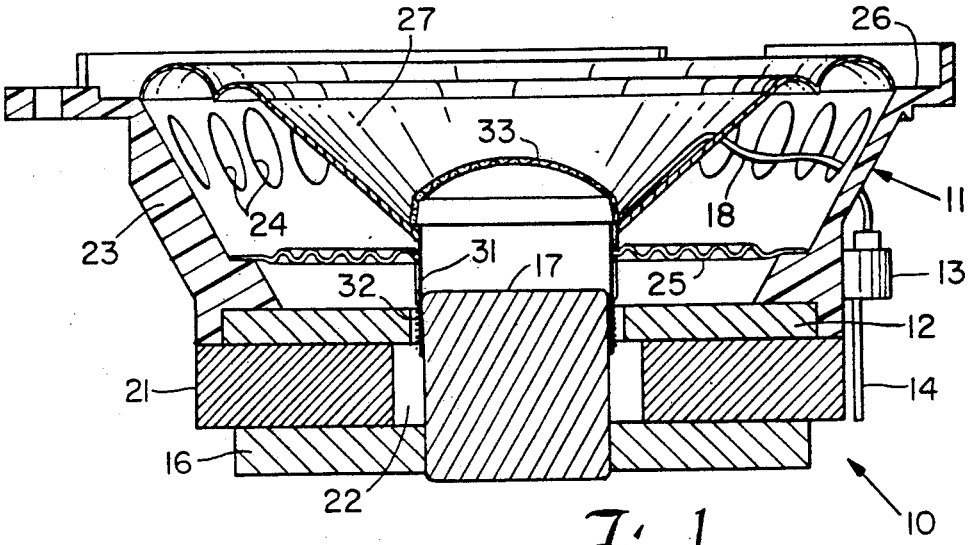
FIG. 1 is a diametrical sectional view through a loudspeaker driver according to the invention.

With reference now to the drawings, there is shown loudspeaker driver 10, which is similar to the loudspeaker described in U.S. Pat. No. 4,061,890, hereby incorporated by reference, except that an improved lead dressing, as described in detail below, is employed. Loudspeaker driver 10 has a plastic basket 11 with an embedded octagonal pole plate 12 of low reluctance magnetic material with plastic tabs such as 13 carrying speaker terminals such as 14 connected to the voice coil via flexible preferably flat tinsel leads 18. Rear octagonal pole plate 16 of low magnetic reluctance is formed with a central opening in which pole piece 17 is force fit and surrounded by high energy annular permanent magnet 21 formed with a central opening 22. Plastic basket 11 is formed with three ribs such as 23 extending radially outward useful in centering the driver when inserted into a speaker mounting hole in the baffle and with an essentially continuous array of generally elliptical ventilating openings such as 24 around the intermediate portion of the basket between the spider 25 and the annular outside mounting lip 26 of cone 27. Voice coil bobbin 31 carries voice coil 32 and is secured to cone 27 and spider 25. Dust cover 33 covers the top opening of bobbin 31.

Figure 2:
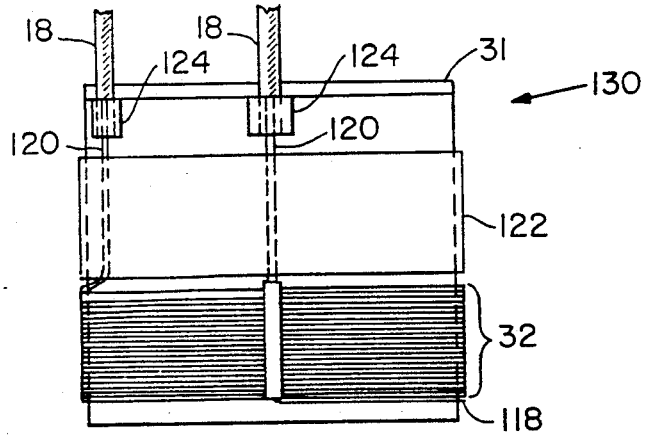
FIG. 2 is an elevation view showing a voice coil and bobbin subassembly of the FIG. 1 loudspeaker driver.
Figure 3:
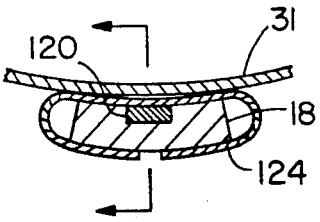
FIG. 3 is a transverse sectional view of a crimped tinsel-voice coil joint used on the FIG. 2 subassembly.
Figure 5:
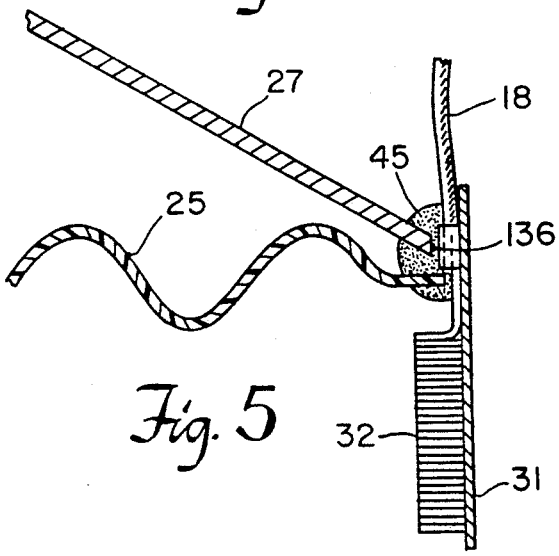
FIG. 5 is an enlarged view of a detail in FIG. 2 (quite diagrammatic and not drawn to scale) showing how the cone, spider and voice coil bobbin of the FIG. 1 loudspeaker driver are secured together.

Referring to FIG. 2, there is shown voice coil and bobbin subassembly 130. Voice coil 32 preferably comprises a single layer of anodized aluminum wire 118 of rectangular cross section with bobbin 31 also of anodized aluminum having an axial slit. The ends 120 of wire 118 bend at different circumferential locations on bobbin 31 and extend axially from voice coil 32 on the outer surface of bobbin 31 underneath fiberglass fixturing tape 122 to crimps 124, used to secure ends 120 to flexible tinsel leads 18. The end 120 extending from the bottom of coil 32 passes through tube 126 over coil 32. Crimps 124 are generally similar to the crimps shown in U.S. Pat. No. 4,737,992, which is hereby incorporated by reference. As can be seen from FIGS. 3 and 4, crimps 124 are generally flat, permitting the cone and spider to be easily dropped over subassembly 130 in production.

Figure 4:
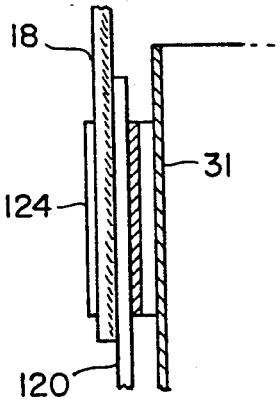
FIG. 4 is a sectional view, taken at section 5—5 of FIG. 4, of the FIG. 4 joint.

Referring to FIG. 4, there is shown an enlarged view of the junction between bobbin 31, cone 27 and spider 25 showing how they are held together by fastening cement 45, such as epoxy resin, or other thermosetting adhesives. Cone 27 has two notches 136 at respective crimps 124 to ensure that cone 27 does not get caught on the crimps during assembly and to avoid cone deformation. (Alternatively, the inner diameter of cone 27 could be increased.) The crimped junction between flexible tinsel leads 18 and ends 120 of voice coil wire 118 are anchored by cement 45. In loudspeaker driver 10 (FIG. 1), voice coil 32 is located in the air gap between pole piece 17 and front pole plate 12 arranged so that the inside of bobbin 31 is just clear of pole piece 17 and voice coil 32 is just clear of the radially inside surface of front pole plate 12.

In manufacture, voice coil and bobbin subassembly 130 is made by winding wire 118 on one end of bobbin 31, securing ends 120 under fixturing tape 122, connecting ends 120 to the ends of flexible tinsel leads 18 by crimps 124, and trimming excess wire. When incorporating subassembly 130 in driver 10, the loose ends of flexible tinsel leads 18 are retained by a plastic gauge in bobbin 31, and subassembly 130 is positioned in the so-called hard parts (basket 11, plates 12, 16, magnet 21, and pole 17). Spider 25 is slid over the upper end of bobbin 31 beyond crimps 124, and a bead of cement 45 is applied to spider 25 around the upper bobbin 31 in the vicinity of crimps 124. Cone 27 is then slid over the upper end of bobbin 31 and moved into the bead of cement 45. The plastic gauge retaining flexible tinsel leads 18 is removed; dust cover 33 is added, and leads 18 are connected to terminals 14.

The crimped connection of the voice coil wire to flexible tinsel leads is thus desirably anchored to the bobbin and done so using the same cement used to secure the spider and the cone to the bobbin and without an additional manufacturing step. Moreover, the encapsulating of the crimps in the neck joint adhesive under the cone and/or spider inner diameters improves the reliability of the connection and its anchoring to the bobbin.

Other embodiments of the invention are within the scope of the following claims.

What is claimed is:

1. A moving coil loudspeaker comprising a bobbin, a cone secured to said bobbin by cement, a spider secured to said bobbin by said cement, a voice coil including a first electrical wire that is wrapped around said bobbin and has ends supported by said bobbin, and flexible second and third electrical wires for making electrical connection of said first electrical wire to external circuitry, said second and third wires being connected to said ends of said first wire by connections that are anchored on said bobbin by said cement securing said spider and said cone to said bobbin.

2. A loudspeaker of claim 1 wherein said electrical connections are crimps.

3. The loudspeaker of claim 1 wherein said electrical connections are between the inner diameter of the voice cone or said spider and said bobbin.

4. The loudspeaker of claim 2 wherein said cone is formed with notches for receiving said crimps.

5. The loudspeaker of claim 1 wherein said first electrical wire has end portions between said voice coil and said ends, and further comprising a fixturing tape that retains said end portions of said first electrical wire on said bobbin.

6. The loudspeaker of claim 1 wherein said first electrical wire has a rectangular cross section.

7. The loudspeaker of claim 1 wherein said second and third electrical wires are tinsel leads.

8. The method of making a moving coil loudspeaker driver comprising providing a voice coil and bobbin subassembly including a first electrical wire wrapped around a bobbin and flexible second and third electrical wires connected to ends of said first electrical wire by connections, and securing a cone, a spider and said connections to said bobbin by a common mass of cement.

9. The method of claim 8 wherein said providing a subassembly includes crimping said ends to said second and third electrical wires, said connections being crimps.

10. The method of claim 8 wherein said securing includes securing said connections between the inner diameter of the voice cone or the spider and the bobbin.

11. The method of claim 10 wherein said voice cone has notches, and wherein said securing includes securing said crimps in said notches.

12. The method of claim 9 wherein said providing a subassembly includes applying a fixturing tape to retain the ends of said first electrical wire in position.

13. The method of claim 12 wherein said securing includes applying a bead of cement around the bobbin in the vicinity of said connections and thereafter moving said voice cone to move its inner diameter into the cement.

* * * * *